US012746587B2

(12) United States Patent
Scheer et al.

(10) Patent No.: US 12,746,587 B2
(45) Date of Patent: Sep. 29, 2026

(54) DEVICES AND METHOD FOR SHAPING A TUBULAR HOLLOW ELEMENT

(71) Applicant: FELSS Systems GmbH, Koenigsbach-Stein (DE)

(72) Inventors: Jean-Marc Scheer, Minversheim (FR); Nadezda Missal, Schwieberdingen (DE); Serjosha Heinrichs, Oberderdingen (DE); Sascha Voegele, Kaempfelbach (DE); Max Olaf Jandt, Keltern (DE)

(73) Assignee: FELSS Systems GmbH, Koenigsbach-Stein (DE)

( * ) Notice: Subject to any disclaimer, the term of this patent is extended or adjusted under 35 U.S.C. 154(b) by 272 days.

(21) Appl. No.: 18/688,388

(22) PCT Filed: Sep. 21, 2022

(86) PCT No.: PCT/EP2022/076221
§ 371 (c)(1),
(2) Date: Mar. 1, 2024

(87) PCT Pub. No.: WO2023/046750
PCT Pub. Date: Mar. 30, 2023

(65) Prior Publication Data

US 2025/0065384 A1 Feb. 27, 2025

(30) Foreign Application Priority Data

Sep. 24, 2021 (EP) ..... 21198852

(51) Int. Cl.
*B21C 1/24* (2006.01)
*B21C 3/16* (2006.01)
*B21C 37/20* (2006.01)

(52) U.S. Cl.
CPC ..... *B21C 1/24* (2013.01); *B21C 3/16* (2013.01); *B21C 37/202* (2013.01)

(58) Field of Classification Search
CPC .... B21C 1/24; B21C 1/22; B21C 3/02; B21C 3/16; B21C 37/20; B21C 37/202; B21C 37/205
See application file for complete search history.

(56) References Cited

U.S. PATENT DOCUMENTS 3,487,673 A * 1/1970 House ..... B21C 1/24 72/283
5,388,329 A 2/1995 Randlett et al.
2022/0134401 A1* 5/2022 Steinmetz ..... B21C 1/18 72/370.04

FOREIGN PATENT DOCUMENTS

DE 30 16 135 A1 10/1981
DE 10 2019 103 926 A1 8/2020
(Continued)

OTHER PUBLICATIONS

FELSS—Axial Forming—"The Aximus Generation Machines", Information Brochure Dated Aug. 6, 2018.
(Continued)

*Primary Examiner* — Debra M Sullivan
(74) *Attorney, Agent, or Firm* — Collard & Roe, P.C.

(57) ABSTRACT

A device for forming a tubular hollow body has a forming die, a mandrel and a forming drive with a die drive. Die profile projections arranged on the outer side of a hollow body wall and mandrel profile intermediate spaces arranged on the inner side of the hollow body wall as well as die profile intermediate spaces arranged on outer side of the hollow body wall and mandrel profile projections arranged on the inner side of the hollow body wall lie opposite to each other on the hollow body wall in the radial direction. A method for forming a tubular hollow body involves moving
(Continued)

the forming die along the hollow body axis, and by exceeding of the flow limit of the material of the hollow body wall, material of the hollow body wall flows into the mandrel profile intermediate spaces, forming an inner profile of the hollow body wall.

15 Claims, 3 Drawing Sheets

(56) References Cited

FOREIGN PATENT DOCUMENTS

| | | | |
|---|---|---|---|
| EP | 1 857 722 | A1 | 11/2007 |
| GB | 1071456 | A | 6/1967 |
| JP | S51-63355 | A | 6/1976 |
| WO | 99/54065 | A1 | 10/1999 |
| WO | 2020/165082 | A1 | 8/2020 |

OTHER PUBLICATIONS

PCT—International Preliminary Report on Patentability of Application No. PCT/EP2022/076221, Dated Apr. 4, 2024 (English translation).
International Search Report of PCT/EP2022/076221, mailed Feb. 15, 2023.
Extended European Search Report dated Mar. 14, 2022 in European Application No. 21198852.2, with English Translation.

* cited by examiner

DEVICES AND METHOD FOR SHAPING A TUBULAR HOLLOW ELEMENT

CROSS REFERENCE TO RELATED APPLICATIONS

This application is the National Stage of PCT/EP2022/076221 filed on Sep. 21, 2022, which claims priority under 35 U.S.C. § 119 of European Application No. 21198852.2 filed on Sep. 24, 2021, the disclosure of which is incorporated by reference. The international application under PCT article 21 (2) was not published in English.

BACKGROUND OF THE INVENTION

The invention relates to a device for forming a tubular hollow body which has a hollow body wall made of a plastically deformable material and a hollow body axis extending in the longitudinal direction of the hollow body, having a forming die designed to be arranged on the outer side of the hollow body and provided with a die opening designed for receiving the hollow body, having a mandrel designed to be arranged in the interior of the hollow body and provided on its circumference with a shape-imparting mandrel profile having mandrel profile projections and mandrel profile intermediate spaces formed between the mandrel profile projections, with the mandrel profile projections and the mandrel profile intermediate spaces extending along the hollow body axis on the mandrel arranged in the interior of the hollow body, and the mandrel profile intermediate spaces opening towards the axially parallel inner side of the hollow body wall, and having a forming drive with a die drive, by means of which the forming die can be moved with an axial die movement along the hollow body axis relative to the hollow body and thereby along the mandrel arranged in the interior of the hollow body, wherein material of the hollow body wall flows into the mandrel profile intermediate spaces of the mandrel due to the axial die movement and an associated exceeding of the flow limit of the material of the hollow body wall, forming an inner profile of the hollow body wall.

The invention also relates to an arrangement for forming a tubular hollow body which has a hollow body wall made of a plastically deformable material and a hollow body axis extending in the longitudinal direction of the hollow body, the arrangement comprising a first forming device and a second forming device, and the second forming device being arranged downstream of the first forming device in a forming process, the first forming device being designed to produce a preform of a finished formed hollow body from the hollow body in an initial state, the preform being designed as a tubular hollow body having a preform wall made of a plastically deformable material and having a preform axis coinciding with the hollow body axis, and the second forming device being designed to produce a subsequent form of the preform, in particular to produce the finished formed hollow body, which has a subsequent form wall.

Furthermore, the invention relates to methods that can be carried out with the aforementioned device and with the aforementioned arrangement, for forming a tubular hollow body that has a hollow body wall made of a plastically deformable material and a hollow body axis extending in the longitudinal direction of the hollow body.

For example, in the manufacturing of hollow shafts for motor vehicles, shaft blanks made of plastically deformable metallic materials are to be provided with external and/or internal toothings and in particular to be reduced in their diameter and/or their wall thickness over partial lengths. A common manufacturing method for producing toothings of shaft blanks is the axial forming by means of a forming tool that comprises a forming die enclosing the shaft blank on the outer side and a mandrel supporting the shaft blank in the interior thereof. Depending on the application, the forming die and/or the mandrel is provided with a shape-imparting toothing. A manufacturing method customary for reducing the diameter and/or wall thickness of shaft blanks is drawing.

Prior art of the generic type is disclosed in DE 10 2019 103 926 A1.

This document relates to a tool and a method for axially forming a tube. The tool comprises an annular die guided on the outer side of the tube and a mandrel guided in the interior of the tube. At the same time as a wall thickness reduction, the tube wall is provided with an internal toothing. A mandrel with a gear-shaped cross-section is used to produce the internal toothing on the tube wall. In the tooth intermediate spaces on the mandrel, the teeth of the internal toothing are formed by the material of the tube wall plasticized due to the forming process.

SUMMARY OF THE INVENTION

The object of the present invention is to provide devices and methods by means of which a tubular hollow body can be provided with a high-quality internal toothing.

According to the invention, this object is achieved by the device, the arrangement and the methods as described below.

In the case of the invention, for producing an internal toothing on a tubular hollow body made of a preferably metallic material and with a preferably circular cross-section, a forming tool is used which has a forming die with a profiled die opening and a mandrel with a profiled circumference. Essential to the invention is the fact that the forming die and the mandrel are rotated relative to one another about the axis of the hollow body to be formed, in such a way that die profile projections of the forming die arranged on one side of the hollow body wall and mandrel profile intermediate spaces arranged on the other side of the hollow body wall lie opposite to each other in the radial direction of the hollow body axis. Due to the mutual positioning of the die profile projections and the mandrel profile intermediate spaces according to the invention, during the forming process, the die profile projections bring about a complete filling of the mandrel profile intermediate spaces with plasticized material of the hollow body wall and, under certain circumstances, also a compaction of the wall material that has flowed into the mandrel profile intermediate spaces. As a result, the mandrel, whose profile reproduces the target geometry of the inner profile of the hollow body wall to be created as a negative, produces the inner profile of the hollow body wall with an actual geometry that deviates at most minimally from the target geometry and is therefore of exceptionally high quality.

According to the invention, the inner profile of the hollow body wall can be produced in a single-stage or in a multi-stage process.

By means of the forming device according to claim 1 and according to the method according to claim 11, the hollow body wall is provided with an inner profile with target geometry in one step.

By means of the arrangement according to claim 7 and according to the method according to claim 13, the creation of the inner profile with target geometry is distributed to a plurality of method stages.

In the first method stage, a preform of the finished formed hollow body is produced from the hollow body in the initial state by means of a first forming device. The inner profile of the preform is subsequently optimized.

The optimization of the inner profile of the preform wall follows in at least one further method stage, in which the inner profile of a subsequent form of the preform, in particular the inner profile of the finished hollow body, is produced from the inner profile of the preform wall by means of a further forming device.

According to the invention, an arrangement with two forming devices for carrying out a two-stage forming method is preferred as a multi-stage arrangement. In this case, the finished formed hollow body with the target geometry of the inner profile on the hollow body wall is directly produced as a subsequent form from the preform.

In the case of the devices and methods according to the invention, the axial die movement can be performed as a continuous movement in the forming direction, but also as a movement with alternately performed long strokes in the forming direction and short return strokes in the opposite direction ("recursive axial forming").

Particular embodiments of the devices and methods according to independent claims 1, 8, 13 and 15 emerge from dependent claims 2 to 7 and 9 to 12.

The measures of dependent claims 2 to 7 can also be provided in a corresponding manner in the case of the arrangement according to the invention with a plurality of forming devices and for carrying out a multi-stage forming method.

According to claim 2, in a preferred embodiment of the invention, an internal toothing is created as an inner profile on the hollow body wall.

According to the invention, when the inner profile of the hollow body wall is created, the size of the hollow body cross-section, which extends perpendicularly to the hollow body axis, can remain unchanged.

In this case, a profiled forming die is used on the device according to the invention according to claim 1 with a die profile, the root line of which lies in the perpendicular projection onto the end face of the hollow body wall in the initial state outside the hollow body wall or coincides with the outer side of the hollow body wall. The tip line of the die profile lies in the perpendicular projection onto the end face of the hollow body wall in the initial state, in a region that can reach from the interior of the hollow body wall into the interior of the cavity of the hollow body.

In the case of applications in which a forming die, which has a circular die opening with a shape-imparting toothing, is used to form a cylindrical hollow body, the root circle of the die toothing provided as the root line accordingly has a root circle diameter that is greater than or equal to the outer diameter of the hollow body to be formed in the initial state. The diameter of the tip circle of the die toothing is smaller than the outer diameter of the cylindrical hollow body in the initial state.

Corresponding is the situation on embodiments of the multi-stage arrangement according to the invention, in the case of which a preform with an unchanged cross-sectional size is manufactured from the hollow body in the initial state by means of the first forming device and/or a subsequent form with an unchanged cross-sectional size is manufactured from the preform by means of the second forming device.

In a preferred embodiment of the invention, the device according to the invention and the arrangement according to the invention as well as the methods according to the invention are such that the creation of the inner profile of the hollow body wall or of the preform wall and/or of the subsequent form wall is accompanied by a reduction of the hollow body cross-section or the preform cross-section (claims 3, 12).

A cross-sectional reduction in the sense of the invention is to be understood as:

- a reduction exclusively of the cavity cross-section of the hollow body to be formed or of the preform to be formed (of the inner diameter of the tube in the case of cylindrical tubes) with an unchanged thickness of the hollow body wall or of the preform wall, or
- a reduction exclusively in the thickness of the hollow body wall or of the preform wall with an unchanged cavity cross-section of the hollow body or of the preform, or
- a reduction in both the cavity cross-section of the hollow body to be formed or of the preform to be formed and the thickness of the hollow body wall or of the preform wall.

An embodiment of the device according to the invention or of the arrangement according to the invention is designed for a cross-sectional reduction of the hollow body by reducing the thickness of the hollow body wall, in the case of which the common cross-section of the mandrel and of the hollow body wall in the initial state is greater than the opening cross-section of the die opening or in the case of which the common cross-section of the first mandrel and of the hollow body wall in the initial state is greater than the opening cross-section of the first die opening and/or in the case of which the common cross-section of the second mandrel and of the preform wall in the initial state is greater than the opening cross-section of the second die opening.

According to claim 4, in a further embodiment of the invention, a stationary axial abutment is provided for the hollow body, on which abutment the hollow body is supported in the direction of the axial die movement when acted upon by the forming die.

The device according to claim 5 and the forming method carried out with this device are intended for applications in which there is a risk of compression phenomena occurring on the hollow body to be formed due to the axial die movement.

In order to avoid compression of the hollow body, the forming drive has a mandrel drive in addition to the die drive. By means of the die drive, the forming die arranged on the outer side of the hollow body is actively moved along the hollow body axis with the axial die movement. Due to the active movement of the forming die relative to the hollow body, the hollow body wall acted upon by the forming die is actively subjected to pressure by the forming die in the direction of the axial die movement. At the same time, the hollow body wall is subjected to tensile stress in the direction of the axial mandrel movement as a result of the axial mandrel movement directed in the opposite direction to the axial die movement.

By means of the drive controller of the forming drive according to the invention, the active axial mandrel movement and the active axial die movement of the forming die arranged on the outer side of the hollow body are superposed on one another. Due to the superposition of the two mentioned movements, the compressive stresses which build up in the hollow body wall due to the impact of the forming die over the wall cross-section are at least partially compensated by the tensile stresses in the hollow body wall resulting from the active axial mandrel movement.

Given corresponding, for example empirical, dimensioning and mutual coordination of the pressure load on the hollow body from the forming die and the tensile load on the hollow body from the mandrel, undesirable compression of the hollow body wall on the side, arranged in the direction of the axial die movement, of the forming die acting on the hollow body wall is at least largely prevented, even without additional reinforcement of the hollow body. At the same time, high forming speeds can be achieved as a result of the superposition of the active die movement and the active mandrel movement.

In general, both the axial mandrel movement and the axial die movement can be controlled both by position and force.

The forming speed of the device according to the invention and of the method according to the invention is largely independent of the material strength of the hollow body to be formed. In the case of high-strength materials, relatively high forming forces are required; at the same time, the tendency of hollow bodies made of high-strength materials to compress is however relatively low. Conversely, tubular hollow bodies made of materials of low strength have a relatively high tendency to compress, but a cross-sectional reduction of such hollow bodies is already possible with relatively low forming forces.

According to claim 5, in the case of the invention, the ratio of the speeds of the axial mandrel movement and of the axial die movement of the forming die arranged on the outer side of the hollow body is set by means of the drive controller of the forming drive as a function of the ratio of the size of the cross-section of the hollow body in the initial state and the cross-sectional size of the hollow body after the forming process. In particular in the case of a cross-sectional reduction, the value of the speed of the axial die movement of the forming die arranged on the outer side of the hollow body can be greater, but also smaller, than the value of the speed of the axial mandrel movement. In the context of an experimental use of the invention, it was possible to achieve high-quality processing results at a die speed of 30 mm/s to 60 mm/s and a mandrel speed of 21 mm/s to 43 mm/s.

According to claim 6, in a further embodiment of the invention, it is provided that the ratio of the values of the axial mandrel movement and of the axial die movement during the forming process is reciprocal to the ratio of the speeds of the axial mandrel movement and of the axial die movement during the forming process. It is thereby ensured that the active mandrel and forming die movements carried out to form a hollow body over a forming length end simultaneously when the forming length is reached despite different speeds of the mandrel and the forming die.

In a further advantageous embodiment of the invention, claim 7 provides that the forming die can be moved by means of the die drive with a positioning movement from a position away from the hollow body to be formed to a position in which the forming die is arranged on the outer side of the hollow body, and that the die drive and the mandrel drive are controlled by means of the drive controller of the device drive in such a way that the mandrel drive initiates the axial mandrel movement before the forming die acts on the hollow body wall due to the positioning movement. Upon the first contact of the forming die with the hollow body to be formed, the mandrel and the hollow body which is driven along the hollow body axis and subjected to tensile stress during the forming process is thus already in movement. Preferably, the positioning movement of the forming die is carried out in the direction of the axial die movement.

In order to carry out the multi-stage forming method, forming devices can be used whose mandrels have mandrel profile intermediate spaces with differently sized intermediate space cross-sections. Preferably, by means of the second mandrel, the inner profile with the target geometry is created from the inner profile of the preform. In doing so, wall material is fed by the second forming die to the profile projections of the inner profile of the preform produced in the mandrel profile intermediate spaces of the first forming die. Accordingly, the first mandrel profile intermediate spaces of the first mandrel have to receive less wall material than the second mandrel profile intermediate spaces of the second mandrel. If, at the same time, the cross-section of the first mandrel profile intermediate spaces is greater than the cross-section of the second mandrel profile intermediate spaces, the first mandrel profile intermediate spaces have an oversize compared to the inner profile of the preform produced on the first mandrel profile, due to which oversize the first mandrel and the preform can be separated from one another with relatively little force after completion of the first method stage.

In a preferred embodiment of the invention, the first shape-imparting mandrel profile of the first mandrel and the second shape-imparting mandrel profile of the second mandrel correspond to one another in their geometry (claim 9). In this way, it can be particularly ensured that the forming process carried out by means of the second mandrel leads to an optimization of the inner profile produced by means of the first mandrel. On the second forming device, by means of the second forming die and the second mandrel interacting therewith, the geometry of the inner profile produced by means of the first mandrel is brought into conformity with the target geometry specified by the identical mandrel profile, or at least brought closer to the target geometry.

Particularly high-quality processing results can be achieved if the same mandrel is used in the second method stage as in the first method stage (claim 11). In this case, the mandrel can remain in the interior of the then present preform after the first method stage has been completed. Therefore, the processing of the preform by the second forming device does not have to be preceded by a mandrel change on the preform, which may impair the processing quality.

According to Claim 10, the first forming die of the multi-stage forming arrangement in a further development of the invention has a die opening with a smooth wall. Accordingly, the optimized filling of the mandrel profile intermediate spaces with plasticized material of the hollow body wall according to the invention takes place exclusively in the second method step of the forming method according to the invention.

In deviation from this, in the case of the embodiment of the invention according to Claim 11, precautions for an optimized filling of the mandrel profile intermediate spaces with plasticized material of the hollow body wall have already been taken on the first forming device of the multi-stage arrangement.

BRIEF DESCRIPTION OF THE DRAWINGS

In the following, the invention is explained in more detail on the basis of schematic illustrations given by way of example. Shown are.

DETAILED DESCRIPTION OF THE EMBODIMENTS

Figure 1:
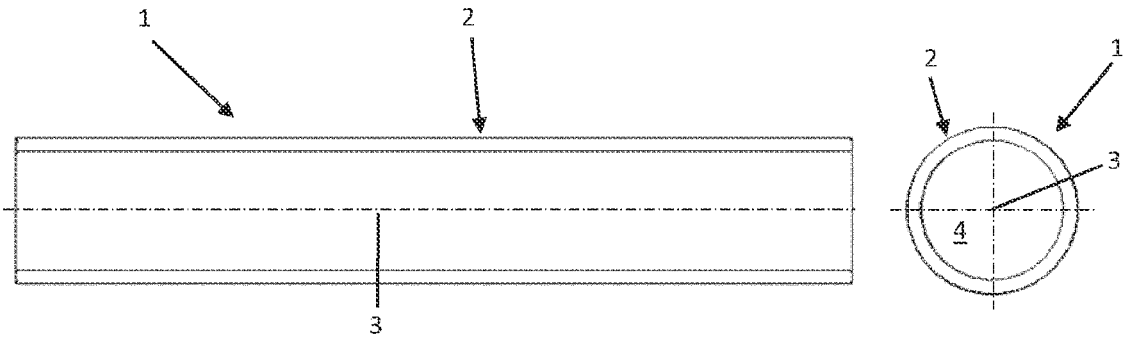
FIG. 1 a tube to be formed in an initial state.

According to FIG. 1, a tube 1 made of a plastically deformable metallic material is provided as the hollow body to be formed. The tube 1 has a tube wall 2 as the hollow body wall and a tube axis 3 extending in the longitudinal direction of the tube 2 as the hollow body axis. The tube 1 is cylindrical with a circular tube cross-section 4 as a hollow body cross-section, which can be seen in the end-face view of the tube 1 in FIG. 1, and with an annular wall cross-section.

A steering shaft for a motor vehicle is to be manufactured from the tube 1.

Figure 2:
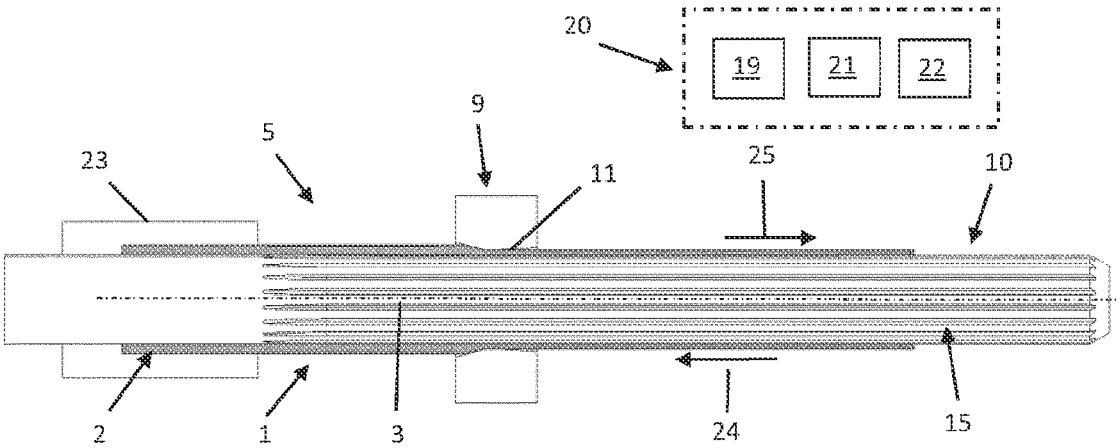
FIG. 2 a single-stage device for forming the tube shown in FIG. 1 in a single-stage forming method with a cross-sectional reduction and with a profiling of the tube wall, FIG. 3*a* a first forming device of a two-stage forming arrangement for producing a preform of a finished formed tube in the context of a two-stage forming method, FIG. 3*b* a second forming device of the two-stage forming arrangement for producing the finished formed tube from the preform shown in FIG. 3*a* in the context of the two-stage forming method, and FIG. 4 a single-stage device for forming the tube shown in FIG. 1 in a single-stage forming method with a profiling of the tube wall, but without a cross-sectional reduction of the tube wall.
Figure 2:
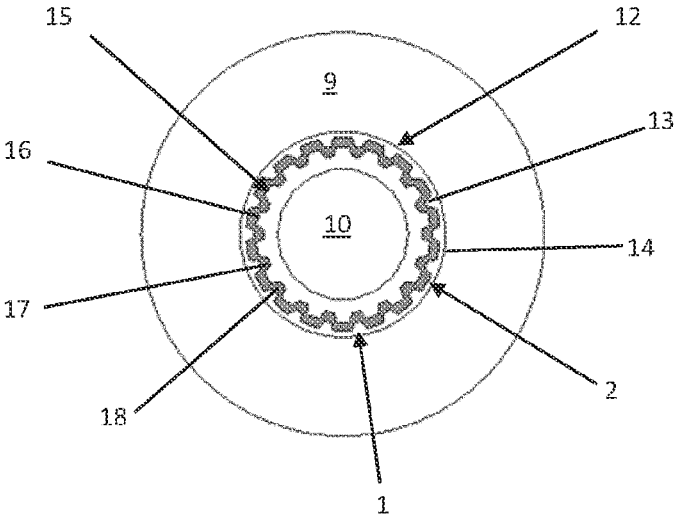
Figure 3A:
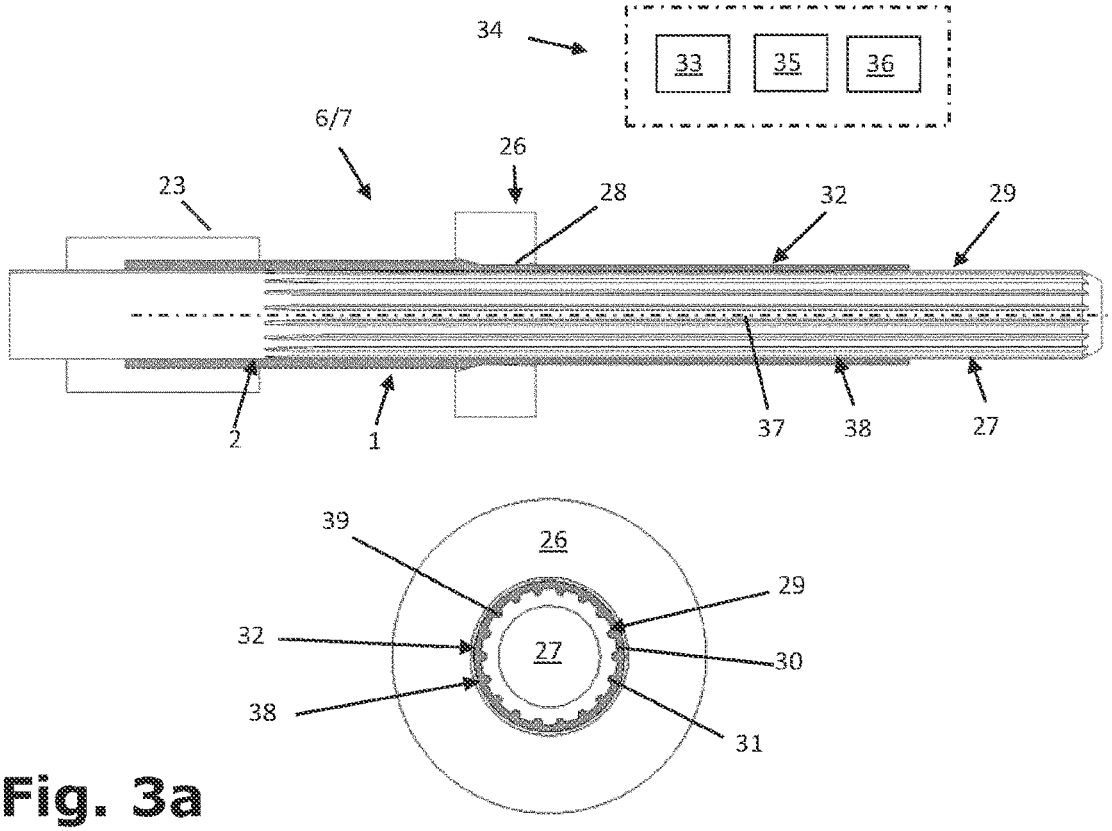
Figure 3B:
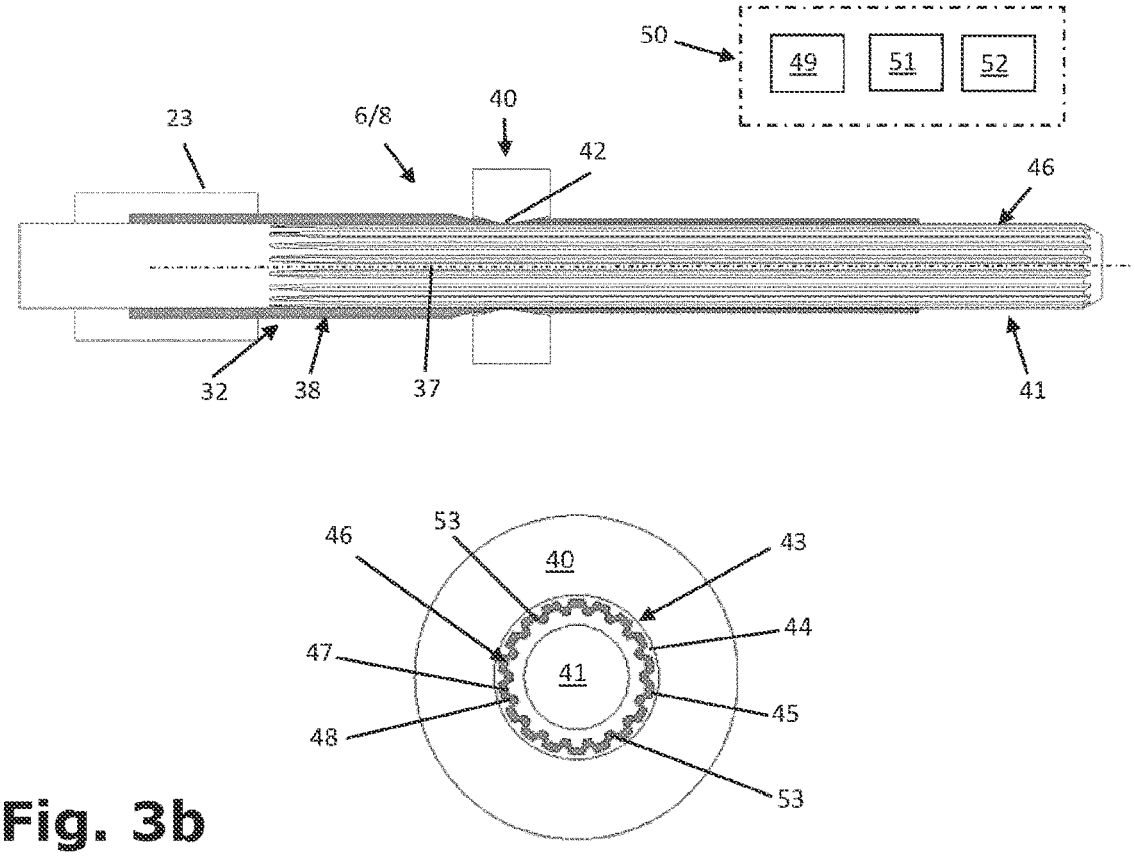
Figure 4:
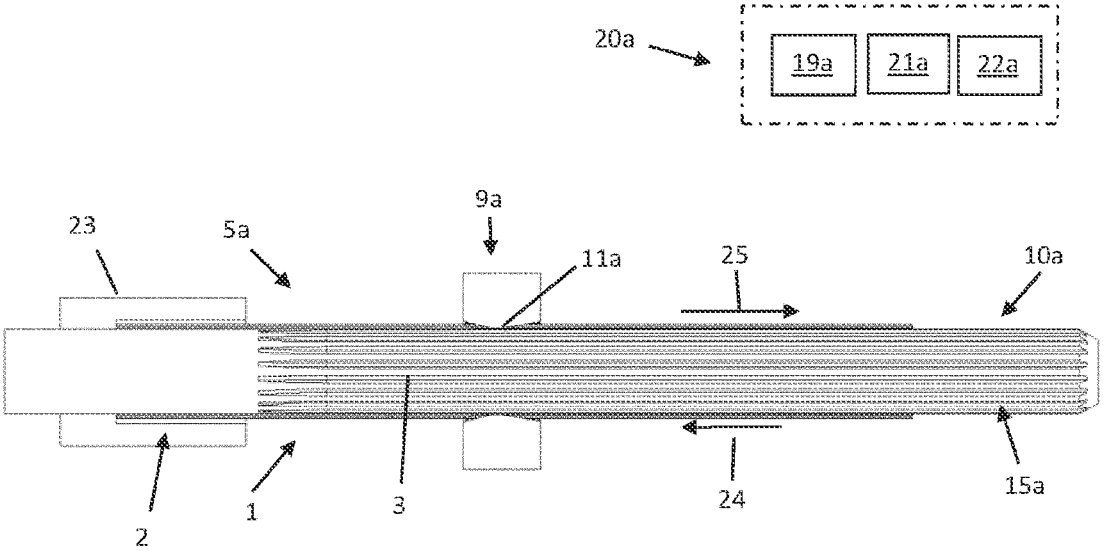
Figure 4:
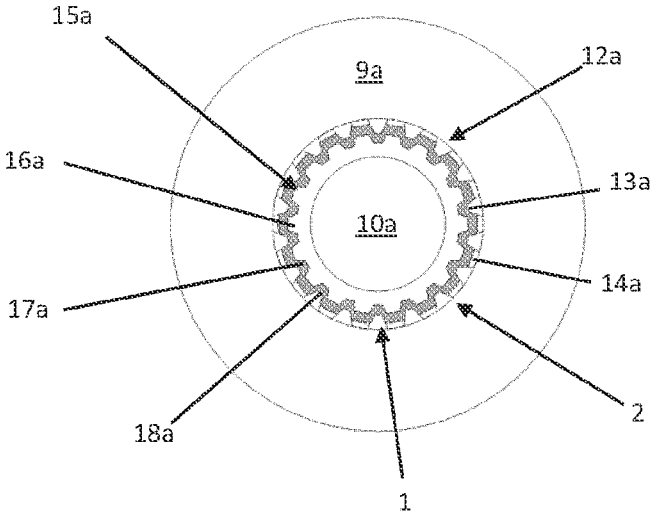

For this purpose, single-stage devices 5, 5*a* shown in FIG. 2 and FIG. 4 are used or, alternatively, a multi-stage arrangement 6 shown in FIGS. 3*a* and 3*b*, which is two-stage in the example shown, is used. The two-stage arrangement 6 comprises a first forming device 7 and a second forming device 8.

The devices 5, 5*a* and the forming devices 7, 8 with the respective formed workpieces are shown in FIG. 2 and in FIGS. 3*a*, 3*b* and 4, in each case in a highly schematized side view and also in a view of the end face that is on the right in the side view.

The device 5 shown in FIG. 2 is mounted on an axial forming machine of conventional design, for example on an axial forming machine such as is offered by FELSS Systems GmbH, 75203 Königsbach-Stein, Germany, under the product name "Aximus."

A forming die 9 of the device 5 designed to be arranged on the outer side of the tube 1 is installed in a tool holder of the axial forming machine that can move along the tube axis 3. A mandrel holder of the axial forming machine, also movable along the tube axis 3, is used to fix a mandrel 10 of the device 5. The tool holder for the forming die 9 and the mandrel holder for the mandrel 10 are not shown in FIG. 2 for the sake of simplicity.

The forming die 9 has a die opening 11 ("calibration section") designed for receiving the tube 1. At the die opening 11, the forming die 9 is provided with a shape-imparting die profile in the form of a shape-imparting die toothing 12. The die toothing 12 has die teeth 13 as die profile projections and die tooth intermediate spaces 14 formed between the die teeth 13 as die profile intermediate spaces. The root circle diameter of the die opening 11 is smaller than the diameter of the tube cross-section 4 in the initial state with the tube 1 still undeformed.

The mandrel 10 is designed to be arranged in the interior of the tube 1 and is provided on its circumference with a shape-imparting mandrel profile designed as a shape-imparting mandrel toothing 15. The shape-imparting mandrel toothing 15 is formed by mandrel profile projections in the form of mandrel teeth 16 and by mandrel tooth intermediate spaces 17 arranged between the mandrel teeth 16 as mandrel profile intermediate spaces.

The die teeth 13 and the die tooth intermediate spaces 14 extend along the tube axis 3 on the forming die 9, which is seated on the outer side of the tube 1. The die tooth intermediate spaces 14 open towards the axially parallel outer side of the tube wall 2.

On the mandrel 10 in the interior of the tube 1, the mandrel teeth 16 and the mandrel tooth intermediate spaces 17 also extend along the tube axis 3. The mandrel tooth intermediate spaces 17 open towards the axially parallel inner side of the tube wall 2.

The forming die 9 and the mandrel 10 are positioned relative to one another around the tube axis 3 in such a way that the die teeth 13 arranged on the axially parallel outer side of the tube wall 2 and the mandrel tooth intermediate spaces 17 arranged on the axially parallel inner side of the tube wall 2 as well as the die tooth intermediate spaces 14 arranged on the axially parallel outer side of the tube wall 2 and the mandrel teeth 16 arranged on the axially parallel inner side of the tube wall 2 in each case lie opposite to each other on the tube wall 2 in the radial direction of the tube axis 3.

By means of the device 5, the tube cross-section 4, specifically the wall thickness of the tube wall 2, is reduced, and at the same time the tube wall 2 is provided on the inner side thereof with an inner profile in the form of an internal toothing 18.

A die drive 19 of a forming drive 20 of the device 5 is used to produce an axial die movement of the forming die 9 required for this purpose. In addition to the die drive 19, the forming drive 20 comprises a mandrel drive 21 and a drive controller 22.

At the start of the forming process, the die drive 19 moves the tool holder of the axial forming machine together with the forming die 9 along the tube axis 3 until the forming die 9 reaches from a position away from the tube 1 the right-hand end of the tube 1 in FIG. 1 and this tube end is directly adjacent to the tube-side mouth of the die opening 11. At this point in time, the tube 1 is still in its undeformed initial state.

In addition, the mandrel drive 21 moves the mandrel holder of the axial forming machine with the mandrel 10 along the tube axis 3 from a position to the left of the tube 1 in FIG. 1 to the right until the mandrel 10 fixed to the mandrel holder assumes the position shown in FIG. 2 in the interior of the tube 1.

The tube 1 to be formed is mounted on the axial forming machine with its left-hand end in FIGS. 1 and 2 on an axial abutment 23 that is stationary along the tube axis 3.

In order to form the tube 1, the forming die 9 is now moved by means of the die drive 19 from its initial position at the right-hand end of the tube 1 with an axial die movement relative to the tube 1, which is supported on the stationary axial abutment 23 and is therefore also stationary, in the direction of the stationary axial abutment 23. During the axial die movement, the forming die 9 moves along the tube axis 3 relative to the tube 1 and also along the mandrel 10 arranged in the interior of the tube 1. The direction of movement of the forming die 9 during the axial die movement is illustrated by an arrow 24 in FIG. 2.

Due to the oversize of the undeformed tube cross-section 4 compared to the opening cross-section of the die opening 11, the axial die movement of the forming die 9 causes the flow limit of the material of the tube wall 2 to be exceeded on the side of the forming die 9 located in the direction of arrow 24. The tube cross-section 4 is reduced due to the axial die movement and material from the tube wall 2 flows into the mandrel tooth intermediate spaces 17 of the mandrel 10, forming the internal toothing 18 of the tube wall 2 and simultaneously elongating the tube wall 2.

The die teeth 13 of the die toothing 12, due to their arrangement opposite the mandrel tooth intermediate spaces 17 of the mandrel 10, ensure that the mandrel tooth intermediate spaces 17 are completely filled with the flowing material of the tube wall 2, and that the internal toothing 18 of the tube wall 2 is therefore produced precisely with its target geometry specified by the mandrel toothing 15.

FIG. 2 illustrates a point in time in the forming process at which the processing of the tube 1 has not yet been completed and the forming die 9 therefore still has a residual path to cover in the direction of the axial abutment 23.

In the case of the tube 1, if there is a risk of the tube 1 being compressed during the forming process, for example due to the tube length, the above kinematics of the forming process are modified.

In deviation from the sequences described above, in order to avoid a compression of the tube 1, an axial mandrel movement of the mandrel 10 directed in the opposite direction to the axial die movement and carried out in the direction of an arrow 25 in FIG. 2 is superposed on the axial die movement of the forming die 9 by means of the drive controller 22.

The speeds of the axial die movement and of the axial mandrel movement can be different in this case. For example, by means of the drive controller 22, the speed of the axial die movement of the forming die 9 in the direction of arrow 24 can be set to 60 mm/s and the speed of the axial mandrel movement of the mandrel 10 in the direction of arrow 25 can be set to 15 mm/s.

When the free end of the tube 1 enters the die opening 11 at the start of the forming process, the tube wall 2 is pressed against the mandrel 10 in the relevant region. A force fit is thereby produced between the tube wall 2 and the mandrel 10.

At the same time, the axial movement of the forming die 9 causes the tube wall 2 to be subjected to pressure on its side located in the direction of arrow 24, and the flow limit of the material of the tube wall 2 is thereby exceeded. The axial abutment 23, which supports the tube 1 acted upon by the forming die 9, is stationary along the tube axis 3 even when an axial die movement and an axial mandrel movement are superposed while the tube 1 is being acted upon by the forming die 9.

As a result of the force fit between the tube wall 2 and the mandrel 10, the tube wall 2, which is acted upon on the outer side by the forming die 9, is subjected to tensile stress in the direction of arrow 25 by means of the mandrel 10. The mandrel 10 driven by means of the mandrel drive 21 therefore actively pulls the tube wall 2 in the direction of arrow 25 through the die opening 11, and the thickness of the tube wall 2 is reduced while simultaneously elongating the tube 1 and simultaneously producing the internal toothing 18 on the tube wall 2.

Due to a corresponding coordination of the axial die movement in the direction of arrow 24 and the axial mandrel movement in the direction of arrow 25, i.e., by corresponding control of the die drive 19 and the mandrel drive 21 by means of the drive controller 22, the forming of the tube wall 2 takes place without the tube 1 being compressed on the side of the forming die 9 located in the direction of arrow 24. As a result, in order to prevent compression of the tube 1, in the case of the device 5 there is also no need for additional reinforcement on the outer side of the tube 1.

Corresponding control of the die drive 19 and the mandrel drive 21 ensures that the die drive 19 and the mandrel drive 21 can be stopped simultaneously when the desired forming length is reached on the tube 1.

Due to the fact that an axial die movement and an axial mandrel movement directed in the opposite direction thereto are carried out at the same time, a high forming speed can be achieved. Regardless of the high forming speed, a high-quality processing result is obtained on the tube 1.

While the devices 5, 5*a* shown in FIG. 2 and FIG. 4 are used to produce the internal toothing on the tube wall 2 in a single-stage forming process, the arrangement 6 shown in FIGS. 3*a* and 3*b* with the first forming device 7 and the second forming device 8 is used to carry out a two-stage forming method.

The first forming device 7 of the arrangement 6 (FIG. 3*a*) comprises a first forming die 26 for arrangement on the outer side of the tube 1 and a first mandrel 27 for arrangement in the interior of the tube 1.

The first forming die 26 of the first forming device 7 is provided with a first die opening 28 for receiving the tube 1. In the example shown, the first die opening 28 is smooth-walled. The diameter of the first die opening 28 corresponds to the root circle diameter of the toothed die opening 11 on the forming die 9 shown in FIG. 2 and is therefore also smaller than the diameter of the tube cross-section 4 of the tube 1 in the undeformed initial state.

On its circumference, the first mandrel 27 of the first forming device 7 has a first shape-imparting mandrel toothing 29 as the first shape-imparting mandrel profile with first mandrel profile projections in the form of first mandrel teeth 30 and first mandrel tooth intermediate spaces 31 formed between the first mandrel teeth 30 as the first mandrel profile intermediate spaces. On the first mandrel 27 arranged in the interior of the tube 1, the first mandrel teeth 30 and the first mandrel tooth intermediate spaces 31 extend along the tube axis 3. The first mandrel tooth intermediate spaces 31 open towards the axially parallel inner side of the tube wall 2. The toothing geometry of the toothed first mandrel 27 of the first forming device 7 forms the target geometry of the toothed inner side of the tube wall 2 on the finished formed tube.

In a first method stage of the two-stage forming process, a preform 32 of the finished formed tube is produced from the undeformed tube 1 in the initial state.

The sequences of the first method stage of the two-stage forming process in principle correspond to the sequences of the single-stage forming method in FIG. 2 described in detail above.

A first die drive 33 of a first forming drive 34 of the first forming device 7 produces an axial die movement of the first forming die 26, which is seated on the tube 1, relative to the tube 1 along the tube axis 3 and along the first mandrel 27 arranged in the interior of the tube 1.

If there is a risk of compression, an axial mandrel movement of the first mandrel 27 carried out by means of a first mandrel drive 35 of the forming drive 34 and directed in the opposite direction to the axial die movement of the first forming die 26 is superposed on the axial die movement of the first forming die 26. The active axial die movement of the first forming die 26 and the active axial mandrel movement of the first mandrel 27 are optionally controlled in a coordinated manner by a first drive controller 36 of the first forming drive 34.

The product of the first method stage of the two-stage forming process is the preform 32 of the finished formed tube with a preform axis 37 coinciding with the tube axis 3 and a preform wall 38. The wall thickness of the preform wall 38 is reduced compared to the wall thickness of the tube wall 2. In addition, the preform wall 38 is provided with an inner profile in the form of an internal toothing 39.

Since the geometry of the internal toothing 39 on the preform wall 38 still has too large a tolerance compared to the target geometry of the finished formed tube, the first method stage shown in FIG. 3*a* is followed by the second method stage of the two-stage forming process carried out by means of the second forming device 8.

According to FIG. 3*b*, the second forming device 8 comprises a second forming die 40 for arrangement on the outer side of the preform 32 and a second mandrel 41 for arrangement in the interior of the preform 32.

A second die opening 42 of the second forming die 40 is designed for receiving the preform 32 and has a shape-imparting die toothing 43 as a shape-imparting die profile on the opening wall. The shape-imparting die toothing 43 is formed by die profile projections in the form of die teeth 44 and die tooth intermediate spaces 45 formed between the die teeth 44 as die profile intermediate spaces.

With the second forming die 40 arranged on the outer side of the preform 32, the die teeth 44 and the die tooth intermediate spaces 45 extend along the preform axis 37. The die tooth intermediate spaces 45 open towards the axially parallel outer side of the preform wall 38. The root circle diameter of the die toothing 43 at the second die opening 42 of the second forming die 40 corresponds to the diameter of the smooth-walled first die opening 28 at the first forming die 26 of the first forming device 7.

The second mandrel 41 of the second forming device 8 has the same design as the first mandrel 27 of the first forming device 7.

On its circumference, the second mandrel 41 has a second shape-imparting mandrel toothing 46 as a second shape-imparting tooth profile with second mandrel profile projections in the form of second mandrel teeth 47 and with second mandrel profile intermediate spaces in the form of second mandrel tooth intermediate spaces 48. Also the second shape-imparting mandrel toothing 46 reproduces the internal toothing to be created on the finished formed tube with its target geometry.

On the second mandrel 41 arranged in the interior of the preform 32, the second mandrel teeth 47 and the second mandrel tooth intermediate spaces 48 extend along the preform axis 37. The second mandrel tooth intermediate spaces 48 open towards the axially parallel inner side of the preform wall 38.

The second forming die 40 and the second mandrel 41 are arranged relative to one another around the preform axis 37 in such a way that the die teeth 44 arranged on the axially parallel outer side of the preform wall 38 and the second mandrel tooth intermediate spaces 48 arranged on the axially parallel inner side of the preform wall 38 as well as the die tooth intermediate spaces 45 arranged on the axially parallel outer side of the preform wall 38 and the second mandrel teeth 47 arranged on the axially parallel inner side of the preform wall 38 in each case lie opposite to each other on the preform wall 38 in the radial direction of the preform axis 37. At the start of the second method stage of the forming process, the mandrel tooth intermediate spaces 48 receive the inner profile 39 of the preform 32 produced in the first method stage.

The sequences of the second method stage of the two-stage forming process also correspond in principle to the sequences of the single-stage forming process carried out by means of the device 5 and shown in FIG. 2.

A second die drive 49 of a second forming drive 50 moves the second forming die 40, which is seated on the preform 32, with an axial die movement relative to the preform 32 along the preform axis 37 and along the second mandrel 41 arranged in the interior of the preform 32.

If there is a risk of compression, an axial mandrel movement of the second mandrel 41 directed in the opposite direction and produced by a second mandrel drive 51 is superposed on the axial die movement of the second forming die 40. In doing so, the second die drive 49 and the second mandrel drive 51 are controlled in a coordinated manner by a second drive controller 52 of the second forming drive 50.

During the second method stage, the die teeth 44 of the die toothing 43 on the second forming die 40, due to their arrangement opposite the second mandrel tooth intermediate spaces 48 of the second mandrel 41, ensure that the second mandrel tooth intermediate spaces 48 are completely filled with the flowing material of the preform wall 38 and that, on the finished formed tube, an internal toothing 53 is therefore produced as an inner profile, the geometry of which corresponds precisely to its target geometry specified by the second mandrel toothing 46.

Just like the device 5 shown in FIG. 2 and the forming devices 7, 8 shown in FIGS. 3*a*, 3*b*, the device 5*a* shown in FIG. 4 is also mounted on an axial forming machine of conventional design.

A forming die 9*a* of the device 5*a* has a die opening 11*a* ("calibration section") designed for receiving the tube 1. At the die opening 11*a*, the forming die 9*a* is provided with a shape-imparting die profile in the form of a shape-imparting die toothing 12*a*. The die toothing 12*a* has die teeth 13*a* as die profile projections and die tooth intermediate spaces 14*a* formed between the die teeth 13*a* as die profile intermediate spaces.

In deviation from the forming die 9 shown in FIG. 2, the root circle diameter of the die toothing 12*a* on the forming die 9*a* is greater than the outer diameter of the tube 1 in the initial state with the tube 1 still undeformed. The tip circle diameter of the die toothing 12*a* is slightly smaller than the inner diameter of the tube 1 in the initial state.

A mandrel 10*a* is designed to be arranged in the interior of the tube 1 and is provided on its circumference with a shape-imparting mandrel profile designed as a shape-imparting mandrel toothing 15*a*. The shape-imparting mandrel toothing 15*a* is formed by mandrel profile projections in the form of mandrel teeth 16*a* and by mandrel tooth intermediate spaces 17*a* arranged 16*a* as mandrel profile intermediate spaces between the mandrel teeth.

The die teeth 13*a* and the die tooth intermediate spaces 14*a* extend along the tube axis 3 on the forming die 9*a*, which is seated on the outer side of the tube 1. The die tooth intermediate spaces 14*a* open towards the axially parallel outer side of the tube wall 2.

On the mandrel 10*a* in the interior of the tube 1, the mandrel teeth 16*a* and the mandrel tooth intermediate spaces 17*a* also extend along the tube axis 3. The mandrel tooth intermediate spaces 17*a* open towards the axially parallel inner side of the tube wall 2.

The forming die 9*a* and the mandrel 10*a* are positioned relative to one another around the tube axis 3 in such a way that the die teeth 13*a* arranged on the axially parallel outer side of the tube wall 2 and the mandrel tooth intermediate spaces 17*a* arranged on the axially parallel inner side of the tube wall 2 as well as the die tooth intermediate spaces 14*a* arranged on the axially parallel outer side of the tube wall 2 and the mandrel teeth 16*a* arranged on the axially parallel inner side of the tube wall 2 in each case lie opposite to each other on the tube wall 2 in the radial direction of the tube axis 3.

Due to the dimensioning of the tip and root circle diameters on the die toothing 12*a*, the device 5*a* produces an inner profile in the form of an internal toothing 18*a* on the inner side of the tube wall 2, without reducing the wall thickness of the tube wall 2.

The sequences in forming the tube 1 by means of the device 5*a* also correspond to the sequences on the device 5 shown in FIG. 2.

A die drive 19*a* of a forming drive 20*a* of the device 5*a* is used to produce an axial die movement of the forming die 9*a*. In addition to the die drive 19*a*, the forming drive 20*a* comprises a mandrel drive 21*a* and a drive controller 22*a*.

In order to form the tube 1, the forming die 9*a* is moved by means of the die drive 19*a* from its initial position at the right-hand end of the tube 1 with an axial die movement relative to the tube 1, which is supported on the stationary axial abutment 23 and is therefore also stationary, in the direction of the stationary axial abutment 23. During the axial die movement, the forming die 9*a* moves in the direction of arrow 24 along the tube axis 3 relative to the tube 1 and also along the mandrel 10*a* arranged in the interior of the tube 1.

Due to the oversize of the undeformed tube wall 2 compared to the tip circle diameter of the die toothing 12*a*, material of the tube wall 2 flows into the mandrel tooth intermediate spaces 17*a* of the mandrel 10*a*, forming the internal toothing 18*a* of the tube wall 2.

Also the die teeth 13*a* of the die toothing 12*a* ensure, due to their arrangement opposite the mandrel tooth intermediate spaces 17*a* of the mandrel 10*a*, that the mandrel tooth intermediate spaces 17*a* are completely filled with the flowing material of the tube wall 2 and the internal toothing 18*a* of the tube wall 2 is therefore produced precisely with its target geometry specified by the mandrel toothing 15*a*.

The invention claimed is:

1. A device for forming a tubular hollow body (1) having a hollow body wall (2) made of a plastically deformable material and a hollow body axis (3) extending in a longitudinal direction of the hollow body (1), comprising:

a forming die (9, 9*a*) designed to be arranged on an outer side of the hollow body (1) and provided with a die opening (11, 11*a*) designed for receiving the hollow body (1), a mandrel (10, 10*a*) designed to be arranged in an interior of the hollow body (1) and provided on a circumference thereof with a shape-imparting mandrel profile (15, 15*a*) having mandrel profile projections (16, 16*a*) and mandrel profile intermediate spaces (17, 17*a*) formed between the mandrel profile projections (16, 16*a*), with the mandrel profile projections (16, 16*a*) and the mandrel profile intermediate spaces (17, 17*a*) extending along the hollow body axis (3) on the mandrel (10, 10*a*) arranged in the interior of the hollow body (1), and the mandrel profile intermediate spaces (17, 17*a*) opening towards an axially parallel inner side of the hollow body wall (2), and a forming drive (20, 20*a*) with a die drive (19, 19*a*), by means of which the forming die (9, 9*a*) can be moved with an axial die movement along the hollow body axis (3) relative to the hollow body (1) and thereby along the mandrel (10, 10*a*) arranged in the interior of the hollow body (1), wherein material of the hollow body wall (2) flows into the mandrel profile intermediate spaces (17, 17*a*) of the mandrel (10, 10*a*) due to axial die movement of the forming die and an associated exceeding of a flow limit of the material of the hollow body wall (2), forming an inner profile (18, 18*a*) of the hollow body wall (2), wherein the forming die (9, 9*a*) is provided at the die opening (11, 11*a*) with a shape-imparting die profile (12, 12*a*) having die profile projections (13, 13*a*) and die profile intermediate spaces (14, 14*a*) formed between the die profile projections (13, 13*a*), wherein, when the forming die (9, 9*a*) is moved with the axial die movement, the die profile projections (13, 13*a*) and the die profile intermediate spaces (14, 14*a*) extend along the hollow body axis (3) and the die profile intermediate spaces (14, 14*a*) open towards the axially parallel outer side of the hollow body wall (2) and die profile projections (13, 13*a*) arranged on the axially parallel outer side of the hollow body wall (2) and mandrel profile intermediate spaces (17, 17*a*) arranged on the axially parallel inner side of the hollow body wall (2) as well as die profile intermediate spaces (14, 14*a*) arranged on the axially parallel outer side of the hollow body wall (2) and mandrel profile projections (16, 16*a*) arranged on the axially parallel inner side of the hollow body wall (2) in each case lie opposite to each other on the hollow body wall (2) in a radial direction of the hollow body axis (3), with the die profile projections (13, 13*a*) impinging material of the hollow body wall (2) in a direction of the mandrel profile intermediate spaces (17, 17*a*) opposite the die profile projections (13, 13*a*), forming the inner profile (18, 18*a*) of the hollow body wall (2), and wherein:

the forming drive (20, 20*a*) has a mandrel drive (21, 21*a*) and a drive controller (22, 22*a*) in addition to the die drive (19, 19*a*), the mandrel drive (21, 21*a*) is configured to move the mandrel (10, 10*a*) arranged in the interior of the hollow body (1) along the hollow body axis (3) through the die opening (11, 11*a*) with an axial mandrel movement counter to the axial die movement, the hollow body wall (2) can be subjected to tensile stress by means of the mandrel (10, 10*a*) in a direction of the axial mandrel movement due to the axial mandrel movement and can thereby be drawn through the die opening (11, 11*a*) relative to the forming die (9, 9*a*) in the direction of the axial mandrel movement, and the drive controller (22, 22*a*) of the forming drive (20, 20*a*) is configured to control the mandrel drive (21, 21*a*) and the die drive (19, 19*a*) in such a way that the axial mandrel movement and the axial die movement are superposed on one another.

2. The device according to claim 1, wherein a mandrel-side toothed profile having mandrel teeth as the mandrel profile projections (16, 16*a*) and having mandrel tooth intermediate spaces as the mandrel profile intermediate spaces (17, 17*a*) is provided as the shape-imparting mandrel profile (15, 15*a*), and wherein a die-side toothed profile having die teeth as the die profile projections (13, 13*a*) and having die tooth intermediate spaces as die profile intermediate spaces (14, 14*a*) is provided as the shape-imparting die profile (12, 12*a*), and wherein die teeth arranged on the axially parallel outer side of the hollow body wall (2) and mandrel tooth intermediate spaces arranged on the axially parallel inner side of the hollow body wall (2) as well as die tooth intermediate spaces arranged on the axially parallel outer side of the hollow body wall (2) and mandrel teeth arranged on the axially parallel inner side of the hollow body wall (2) lie opposite to each other on the hollow body wall (2) in the radial direction of the hollow body axis (3) and the die teeth impinge material of the hollow body wall (2) in the direction of the mandrel tooth intermediate spaces opposite the die teeth, forming the inner profile (18, 18*a*) of the hollow body wall (2).

3. The device according to claim 1, wherein the die opening (11) has an opening cross-section that is smaller than a hollow body cross-section (4), extending perpendicularly to the hollow body axis (3), in an initial state, and wherein the cross-section (4) of the hollow body (1) is reduced due to the axial die movement and an associated exceeding of the flow limit of the material of the hollow body wall (2).

4. The device according to claim 1, wherein an axial abutment (23) is provided for the hollow body (1), on which abutment the hollow body (1) is supported in the direction of the axial die movement and which abutment is stationary along the hollow body axis (3) during the axial die movement carried out by the forming die (9) relative to the hollow body (1).

5. The device according to claim 1, wherein the drive controller (22, 22*a*) is configured to control the die drive (19, 19*a*) and the mandrel drive (21, 21*a*)—in such a way that a ratio of speeds of the axial mandrel movement and of the axial die movement is dependent on a ratio of the cross-section of the hollow body (1) in an initial state and the cross-section of the hollow body (1) after a forming process.

6. The device according to claim 1, wherein a ratio of amounts of the axial mandrel movement and of the axial die movement is reciprocal to a ratio of speeds of the axial mandrel movement and of the axial die movement.

7. The device according to claim 1, wherein the forming die (9, 9*a*) is movable by means of the die drive (19, 19*a*) with a positioning movement from a position away from the hollow body (1) to be formed to a position in which the forming die (9, 9*a*) is arranged on the outer side of the hollow body (1) and the drive controller (22, 22*a*) is configured to control the die drive (19, 19*a*) and the mandrel drive (21, 21*a*) in such a way that the mandrel drive (21, 21*a*) initiates the axial mandrel movement before the forming die (9, 9*a*) is arranged on the outer side of the hollow body (1) due to the positioning movement of the forming die (9, 9*a*).

8. An arrangement for forming a tubular hollow body (1) having a hollow body wall (2) made of a plastically deformable material and a hollow body axis (3) extending in the longitudinal direction of the hollow body (1), comprising:

a first forming device (7) and a second forming device (8), the second forming device (8) being arranged downstream of the first forming device (7) in a forming process, wherein the first forming device (7) is designed to produce a preform (32) of a finished formed hollow body from the hollow body (1) in an initial state, wherein the preform (32) is designed as a tubular hollow body having a preform wall (38) made of a plastically deformable material and having a preform axis (37) coinciding with the hollow body axis (3), and wherein the second forming device (8) is designed to produce a subsequent form of from the preform (32), which has a subsequent form wall, wherein the subsequent form is the fully formed hollow body, wherein the first forming device (7) comprises:

a first forming die (26) designed to be arranged on an outer side of the hollow body (1) and provided with a first die opening (28) designed for receiving the hollow body (1), a first mandrel (27) designed to be arranged in an interior of the hollow body (1) and provided on a circumference with a first shape-imparting mandrel profile (29) having first mandrel profile projections (30) and first mandrel profile intermediate spaces (31) formed between the first mandrel profile projections (30), with the first mandrel profile projections (30) and the first mandrel profile intermediate spaces (31) extending along the hollow body axis (3) on the first mandrel (27) arranged in the interior of the hollow body (1), and the first mandrel profile intermediate spaces (31) opening towards an axially parallel inner side of the hollow body wall (2), and a first forming drive (34) with a first die drive (33), by means of which the first forming die (26) is movable with an axial die movement along the hollow body axis (3) relative to the hollow body (1) and thereby along the first mandrel (27) arranged in the interior of the hollow body (1), wherein material of the hollow body wall (2) flows into the first mandrel profile intermediate spaces (31) of the first mandrel (27) due to an axial die movement of the first forming die (26) and an associated exceeding of a flow limit of the material of the hollow body wall (2), forming an inner profile (39) of the preform wall (38), and wherein the second forming device comprises:

a second forming die (40) designed to be arranged on an outer side of the preform (32) and having a second die opening (42) designed for receiving the preform (32), a second mandrel (41) designed to be arranged in an interior of the preform (32) and provided on a circumference with a second shape-imparting mandrel profile (46) having second mandrel profile projections (47) and second mandrel profile intermediate spaces (48) formed between the second mandrel profile projections (47), with the second mandrel profile projections (47) and the second mandrel profile intermediate spaces (48) extending along a preform axis (37) on the second mandrel (41) arranged in the interior of the preform (32), and the second mandrel profile intermediate spaces (48) opening towards an axially parallel inner side of the preform wall (38) and receiving the an inner profile (39) of the preform wall (38), and a second forming drive (50) with a second die drive (49), by means of which the second forming die (40) is movable with an axial die movement along the preform axis (37) relative to the preform (32) and thereby along the second mandrel (41) arranged in the interior of the preform (32), wherein material of the preform (32) flows into the second mandrel profile intermediate spaces (48) of the second mandrel (41) due to the axial die movement of the second forming die (40) and an associated exceeding of a flow limit of the material of the preform wall (38), forming an inner profile (53) of the subsequent form wall, wherein the second forming die (40) is provided at the second die opening (42) with a shape-imparting die profile (43) having die profile projections (44) and die profile intermediate spaces (45) formed between the die profile projections (44), and wherein, when the second forming die (40) is moved with the axial die movement, the die profile projections (44) and the die profile intermediate spaces (45) of the second forming die (40) extend along the preform axis (37) and the die profile intermediate spaces (45) open towards an axially parallel outer side of the preform wall (38) and die profile projections (44) arranged on the axially parallel outer side of the preform wall (38) and second mandrel profile intermediate spaces (48) arranged on the axially parallel inner side of the preform wall (38) as well as die profile intermediate spaces (45) arranged on the axially parallel outer side of the preform wall (38) and second mandrel profile projections (47) arranged on the axially parallel inner side of the preform wall (38) in each case lie opposite to each other on the preform wall (38) in a radial direction of the preform axis (37), with the die profile projections (44) impinging material of the preform wall (38) in a direction of the second mandrel profile intermediate spaces (48) opposite the die profile projections (44), forming the inner profile (53) of the subsequent form wall, and wherein:

at least one of the first or second forming drives (34, 50) has a mandrel drive (21, 21*a*) and a drive controller (22, 22*a*) in addition to the die drive (33, 49), the mandrel drive (21, 21*a*) is configured to move the first or second mandrel (27, 41) arranged in the interior of the hollow body (1) along the hollow body axis (3) through the die opening (11, 11*a*) with an axial mandrel movement counter to the axial die movement, the hollow body wall (2) can be subjected to tensile stress by means of the first or second mandrel (27, 41) driven by the mandrel drive in a direction of the axial mandrel movement due to the axial mandrel movement and can thereby be drawn through the die opening (11, 11*a*) relative to the respective first or second forming die (26, 40) in the direction of the axial mandrel movement, and the drive controller (22, 22*a*) of the first or second forming drive (34, 50) is configured to control the mandrel drive (21, 21*a*) and the respective first or second die drive (33, 49) in such a way that the axial mandrel movement and the axial die movement are superposed on one another.

9. The arrangement according to claim 8, wherein the first shape-imparting mandrel profile (29) of the first mandrel (27) and the second shape-imparting mandrel profile (46) of the second mandrel (41) correspond to one another in their geometry.

10. The arrangement according to claim 8, wherein the first die opening (28) of the first forming die (26) has a smooth opening wall.

11. The arrangement according to claim 8, wherein the first forming die (26) is provided at the first die opening (28) with a first shape-imparting die profile having first die profile projections and first die profile intermediate spaces formed between the first die profile projections, wherein, when the first forming die (26) is moved with the axial die movement, the first die profile projections and the first die profile intermediate spaces extend along the hollow body axis (3) and the first die profile intermediate spaces open towards the axially parallel outer side of the hollow body wall (2), and first die profile projections arranged on the axially parallel outer side of the hollow body wall (2) and first mandrel profile intermediate spaces arranged on the axially parallel inner side of the hollow body wall (2) as well as first die profile intermediate spaces arranged on the axially parallel outer side of the hollow body wall (2) and first mandrel profile projections arranged on the axially parallel inner side of the hollow body wall (2) in each case lie opposite to each other on the hollow body wall (2) in the radial direction of the hollow body axis (3), with the first die profile projections impinging material of the hollow body wall (2) in the direction of the first mandrel profile intermediate spaces opposite the first die profile projections, forming the inner profile (39) of the preform wall (38).

12. The arrangement according to claim 8, wherein the first die opening (28) of the first forming die (26) has an opening cross-section that is smaller than a hollow body cross-section (4) of the hollow body (1) in the initial state, the hollow body cross-section (4) extending perpendicularly to the hollow body axis (3), with the cross-section (4) of the hollow body (1) being reduced due to the axial die movement of the first forming die (26) and an associated exceeding of the flow limit of the material of the hollow body wall (2) and/or wherein the second die opening (42) of the second forming die (40) has an opening cross-section that is smaller than a preform cross-section of the preform (32) extending perpendicularly to the preform axis (37), with the cross-section of the preform (32) being reduced due to the axial die movement of the second forming die (40) and an associated exceeding of the flow limit of the material of the preform wall (38).

13. A method for forming a tubular hollow body (1) having a hollow body wall (2) made of a plastically deformable material and a hollow body axis (3) extending in the longitudinal direction of the hollow body (1), arranging a forming die (9, 9*a*) on the outer side of the hollow body (1) and providing the forming die with a die opening (11, 11*a*) designed for receiving the hollow body (1), arranging a mandrel (10, 10*a*) in the interior of the hollow body (1) and providing the mandrel on a circumference with a shape-imparting mandrel profile (15, 15*a*) having mandrel profile projections (16, 16*a*) and mandrel profile intermediate spaces (17, 17*a*) formed between the mandrel profile projections (16, 16*a*), with the mandrel profile projections (16, 16*a*) and the mandrel profile intermediate spaces (17, 17*a*) extending along the hollow body axis (3) on the mandrel (10, 10*a*) arranged in an interior of the hollow body (1), and the mandrel profile intermediate spaces (17, 17*a*) opening towards an axially parallel inner side of the hollow body wall (2), moving the forming die (9, 9*a*) by means of a die drive (19, 19*a*) of a forming drive (20, 20*a*) with an axial die movement along the hollow body axis (3) relative to the hollow body (1) and thereby along the mandrel (10, 10*a*) arranged in the interior of the hollow body (1), wherein material of the hollow body wall (2) flows into the mandrel profile intermediate spaces (17, 17*a*) of the mandrel (10, 10*a*) due to the axial die movement and an associated exceeding of the flow limit of the material of the hollow body wall (2), forming an inner profile (18, 18*a*) of the hollow body wall (2), wherein the forming die (9, 9*a*) is moved by means of the die drive (19, 19*a*) with the axial die movement relative to the hollow body (1), which forming die is provided at the die opening (11, 11*a*) with a shape-imparting die profile (12, 12*a*) having die profile projections (13, 13*a*) and die profile intermediate spaces (14, 14*a*) formed between the die profile projections (13, 13*a*), wherein, when the forming die (9, 9*a*) is moved with the axial die movement, the die profile projections (13, 13*a*) and the die profile intermediate spaces (14, 14*a*) extend along the hollow body axis (3) and the die profile intermediate spaces (14, 14*a*) open towards an axially parallel outer side of the hollow body wall (2) and die profile projections (13, 13*a*) arranged on the axially parallel outer side of the hollow body wall (2) and mandrel profile intermediate spaces (17, 17*a*) arranged on the axially parallel inner side of the hollow body wall (2) as well as die profile intermediate spaces (14, 14*a*) arranged on the axially parallel outer side of the hollow body wall (2) and mandrel profile projections (16, 16*a*) arranged on the axially parallel inner side of the hollow body wall (2) in each case lie opposite to each other on the hollow body wall (2) in a radial direction of the hollow body axis (3), with the die profile projections (13, 13*a*) impinging material of the hollow body wall (2) in a direction of the mandrel profile intermediate spaces (17, 17*a*) opposite the die profile projections (13, 13*a*), forming the inner profile (18, 18*a*) of the hollow body wall (2), wherein the forming drive (20, 20*a*) has a mandrel drive (21, 21*a*) and a drive controller (22, 22*a*) in addition to the die drive (19, 19*a*), wherein the mandrel drive (21, 21*a*) moves the mandrel (10, 10*a*) arranged in the interior of the hollow body (1) along the hollow body axis (3) through the die opening (11, 11*a*) with an axial mandrel movement counter to the axial die movement, wherein the hollow body wall (2) is subjected to tensile stress by means of the mandrel (10, 10*a*) in a direction of the axial mandrel movement due to the axial mandrel movement and is thereby drawn through the die opening (11, 11*a*) relative to the forming die (9, 9*a*) in the direction of the axial mandrel movement, and wherein the drive controller (22, 22*a*) of the forming drive (20, 20*a*) controls the mandrel drive (21, 21*a*) and the die drive (19, 19*a*) in such a way that the axial mandrel movement and the axial die movement are superposed on one another.

14. A method for forming a tubular hollow body (1) having a hollow body wall (2) made of a plastically deformable material and a hollow body axis (3) extending in the longitudinal direction of the hollow body (1), the method comprising a first method stage and a second method stage with the second method stage following the first method stage in the method, a preform (32) of a finished formed hollow body being produced in the first method stage from the hollow body (1) in an initial state, the preform (32) being designed as a tubular hollow body (1) having a preform wall (38) made of a plastically deformable material and having a preform axis (37) coinciding with the hollow body axis (3), and in the second method stage, a subsequent form of the preform (32), which is the finished formed hollow body, is produced, which has a subsequent form wall, wherein in the first method stage the following steps are performed:

arranging a first forming die (26) of a first forming device (7) on an outer side of the hollow body (1) in such a way that the first forming die (26) receives the hollow body (1) at a first die opening (28), arranging a first mandrel (27) of the first forming device (7) in an interior of the hollow body (1) and providing the first mandrel on a circumference with a first shape-imparting mandrel profile (29) having first mandrel profile projections (30) and first mandrel profile intermediate spaces (31) formed between the first mandrel profile projections (30), with the first mandrel profile projections (30) and the first mandrel profile intermediate spaces (31) extending along the hollow body axis (3) on the first mandrel (27) arranged in the interior of the hollow body (1), and the first mandrel profile intermediate spaces (31) opening towards an axially parallel inner side of the hollow body wall (2), and moving the first forming die (26) by means of a first die drive (33) of a first forming drive (34) of the first forming device (7) with an axial die movement along the hollow body axis (3) relative to the hollow body (1) and thereby along the first mandrel (27) arranged in the interior of the hollow body (1), wherein material of the hollow body wall (2) flows into the first mandrel profile intermediate spaces (31) of the first mandrel (27) due to the axial die movement of the first forming die (26) and an associated exceeding of the flow limit of the material of the hollow body wall (2), forming an inner profile (39) of the preform wall (38), and in the second method stage, the following method steps are performed:

arranging a second forming die (40) of a second forming device (8) on an outer side of the preform (32) in such a way that the second forming die (40) receives the preform (32) at a second die opening (42), arranging a second mandrel (41) of the second forming device (8) in an interior of the preform (32) and providing the second mandrel on a circumference with a second shape-imparting mandrel profile (46) having second mandrel profile projections (47) and second mandrel profile intermediate spaces (48) formed between the second mandrel profile projections (47), with the second mandrel profile projections (47) and the second mandrel profile intermediate spaces (48) extending along the preform axis (37) on the second mandrel (41) arranged in the interior of the preform (32), and the second mandrel profile intermediate spaces (48) opening towards an axially parallel inner side of the preform wall (38) and receiving the inner profile of the preform wall (38), and moving the second forming die (40) by means of a second die drive (49) of a second forming drive (50) of the second forming device (8) with an axial die movement along the preform axis (37) relative to the preform (32) and thereby along the second mandrel (41) arranged in the interior of the preform (32), wherein material of the preform (32) flows into the second mandrel profile intermediate spaces (48) of the second mandrel (41) due to the axial die movement of the second forming die (40) and an associated exceeding of the flow limit of the material of the preform wall (38), forming an inner profile (53) of a subsequent form wall, wherein the second forming die (40) is moved by means of the second die drive (49) with the axial die movement relative to the preform (32), which second forming die is provided at the second die opening (42) with a shape-imparting die profile (43) having die profile projections (44) and die profile intermediate spaces (45) formed between the die profile projections (44), wherein, when the second forming die (40) is moved with the axial die movement, wherein the die profile projections (44) and the die profile intermediate spaces (45) of the second forming die (40) extend along the preform axis (37) and the die profile intermediate spaces (45) open towards an axially parallel outer side of the preform wall (38) and wherein die profile projections (44) arranged on the axially parallel outer side of the preform wall (38) and second mandrel profile intermediate spaces (48) arranged on the axially parallel inner side of the preform wall (38) as well as die profile intermediate spaces (45) arranged on the axially parallel outer side of the preform wall (38) and second mandrel profile projections (47) arranged on the axially parallel inner side of the preform wall (38) in each case lie opposite to each other on the preform wall (38) in a radial direction of the preform axis (37), with the die profile projections (44) impinging material of the preform wall (38) in a direction of the second mandrel profile intermediate spaces (48) opposite the die profile projections (44), forming the inner profile (53) of the subsequent form wall, wherein at least one of the first or second forming drives (34, 50) has a mandrel drive (21, 21*a*) and a drive controller (22, 22*a*) in addition to the die drive (33, 49), wherein the mandrel drive (21, 21*a*) moves the first or second mandrel (27, 41) arranged in the interior of the hollow body (1) along the hollow body axis (3) through the die opening (11, 11*a*) with an axial mandrel movement counter to the axial die movement, wherein the hollow body wall (2) is subjected to tensile stress by means of the first or second mandrel (27, 41) driven by the mandrel drive in a direction of the axial mandrel movement due to the axial mandrel movement and is thereby drawn through the die opening (11, 11*a*) relative to the respective first or second forming die (26, 40) in the direction of the axial mandrel movement, and wherein the drive controller (22, 22*a*) of the first or second forming drive (34, 50) controls the mandrel drive (21, 21*a*) and the respective first or second die drive (33, 49) in such a way that the axial mandrel movement and the axial die movement are superposed on one another in the first or second forming stage.

15. An arrangement for forming a tubular hollow body (1) having a hollow body wall (2) made of a plastically deformable material and a hollow body axis (3) extending in the longitudinal direction of the hollow body (1), comprising:

a first forming device (7) and a second forming device (8), the second forming device (8) being arranged downstream of the first forming device (7) in a forming process, wherein the first forming device (7) is designed to produce a preform (32) of a finished formed hollow body from the hollow body (1) in an initial state, wherein the preform (32) is designed as a tubular hollow body having a preform wall (38) made of a plastically deformable material and having a preform axis (37) coinciding with the hollow body axis (3), and wherein the second forming device (8) is designed to produce a subsequent form from the preform (32), which has a subsequent form wall, wherein the subsequent form is the fully formed hollow body, wherein the first forming device (7) comprises:

a first forming die (26) designed to be arranged on an outer side of the hollow body (1) and provided with a first die opening (28) designed for receiving the hollow body (1), a mandrel (27) designed to be arranged in an interior of the hollow body (1) and provided on a circumference with a shape-imparting mandrel profile (29) having mandrel profile projections (30) and mandrel profile intermediate spaces (31) formed between the mandrel profile projections (30), with the mandrel profile projections (30) and the mandrel profile intermediate spaces (31) extending along the hollow body axis (3) on the mandrel (27) arranged in the interior of the hollow body (1), and the mandrel profile intermediate spaces (31) opening towards an axially parallel inner side of the hollow body wall (2), and a first forming drive (34) with a first die drive (33), by means of which the first forming die (26) is movable with an axial die movement along the hollow body axis (3) relative to the hollow body (1) and thereby along the mandrel (27) arranged in the interior of the hollow body (1), wherein material of the hollow body wall (2) flows into the mandrel profile intermediate spaces (31) of the mandrel (27) due to an axial die movement of the first forming die (26) and an associated exceeding of a flow limit of the material of the hollow body wall (2), forming an inner profile (39) of the preform wall (38), and wherein the second forming device comprises:

a second forming die (40) designed to be arranged on an outer side of the preform (32) and having a second die opening (42) designed for receiving the preform (32), the mandrel (27), and a second forming drive (50) with a second die drive (49), by means of which the second forming die (40) is movable with an axial die movement along the preform axis (37) relative to the preform (32) and thereby along the mandrel (27) arranged in the interior of the preform (32), wherein material of the preform (32) flows into the second mandrel profile intermediate spaces (31) of the mandrel (27) due to the axial die movement of the second forming die (40) and an associated exceeding of a flow limit of the material of the preform wall (38), forming an inner profile (53) of the subsequent form wall, wherein the second forming die (40) is provided at the second die opening (42) with a shape-imparting die profile (43) having die profile projections (44) and die profile intermediate spaces (45) formed between the die profile projections (44), and wherein, when the second forming die (40) is moved with the axial die movement, the die profile projections (44) and the die profile intermediate spaces (45) of the second forming die (40) extend along the preform axis (37) and the die profile intermediate spaces (45) open towards an axially parallel outer side of the preform wall (38) and die profile projections (44) arranged on the axially parallel outer side of the preform wall (38) and second mandrel profile intermediate spaces (48) arranged on the axially parallel inner side of the preform wall (38) as well as die profile intermediate spaces (45) arranged on the axially parallel outer side of the preform wall (38) and mandrel profile projections (30) arranged on the axially parallel inner side of the preform wall (38) in each case lie opposite to each other on the preform wall (38) in a radial direction of the preform axis (37), with the die profile projections (44) impinging material of the preform wall (38) in a direction of the mandrel profile intermediate spaces (31) opposite the die profile projections (44), forming the inner profile (53) of the subsequent form wall, and wherein:

at least one of the first or second forming drives (34, 50) has a mandrel drive (21, 21*a*) and a drive controller (22, 22*a*) in addition to the die drive (33, 49), the mandrel drive (21, 21*a*) is configured to move the mandrel (27) arranged in the interior of the hollow body (1) along the hollow body axis (3) through the die opening (11, 11*a*) with an axial mandrel movement counter to the axial die movement, the hollow body wall (2) can be subjected to tensile stress by means of the mandrel (41) driven by the mandrel drive in a direction of the axial mandrel movement due to the axial mandrel movement and can thereby be drawn through the die opening (11, 11*a*) relative to the respective first or second forming die (26, 40) in the direction of the axial mandrel movement, and the drive controller (22, 22*a*) of the first or second forming drive (34, 50) is configured to control the mandrel drive (21, 21*a*) and the respective first or second die drive (33, 49) in such a way that the axial mandrel movement and the axial die movement are superposed on one another.

* * * * *